US012473807B2

(12) United States Patent
Manchanda et al.

(10) Patent No.: US 12,473,807 B2
(45) Date of Patent: Nov. 18, 2025

(54) SYSTEM AND METHOD FOR HYDRAULIC FRACTURE PROPAGATION

(71) Applicant: ExxonMobil Technology and Engineering Company, Spring, TX (US)

(72) Inventors: Ripudaman Manchanda, Houston, TX (US); Timothy G. Benish, Spring, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 0 days.

(21) Appl. No.: 18/748,437

(22) Filed: Jun. 20, 2024

(65) Prior Publication Data

US 2025/0020048 A1 Jan. 16, 2025

Related U.S. Application Data

(60) Provisional application No. 63/512,992, filed on Jul. 11, 2023.

(51) Int. Cl.
*E21B 43/26* (2006.01)
*E21B 43/30* (2006.01)

(52) U.S. Cl.
CPC ..... *E21B 43/26* (2013.01); *E21B 43/30* (2013.01)

(58) Field of Classification Search
CPC ..... E21B 43/26; E21B 43/30; E21B 43/305
See application file for complete search history.

(56) References Cited

U.S. PATENT DOCUMENTS

2021/0079788 A1* 3/2021 Wang ..... E21B 49/008
2024/0229630 A1* 7/2024 Manchanda ..... E21B 43/30

* cited by examiner

*Primary Examiner* — James G Sayre
(74) *Attorney, Agent, or Firm* — ExxonMobil Technology and Engineering Company—Law Department

(57) ABSTRACT

A method involves propagating hydraulic fractures in a reservoir. Such method includes creating a low pressure region in an attractor well. The attractor well is proximate to an area in which hydraulic fractures are desired. The method also includes initiating a hydraulic fracturing operation at a treatment well. The hydraulic fracturing operation is initiated so that a fracture network created by the hydraulic fracturing operation is drawn to propagate toward the low pressure region of the attractor well.

20 Claims, 9 Drawing Sheets

500

SYSTEM AND METHOD FOR HYDRAULIC FRACTURE PROPAGATION

CROSS-REFERENCE TO RELATED APPLICATION

This application claims priority to and the benefit of U.S. Provisional Application No. 63/512,992, entitled "SYSTEM AND METHOD FOR HYDRAULIC FRACTURE PROPAGATION," having a filing date of Jul. 11, 2023, the disclosure of which is incorporated herein by reference in its entirety.

FIELD OF THE INVENTION

The techniques described herein relate generally to the field of hydrocarbon well completions and hydraulic fracturing operations. More specifically, the techniques described herein relate to directing the propagation of hydraulic fractures in the subsurface as the hydraulic fractures are being created.

BACKGROUND OF THE INVENTION

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

Low-permeability hydrocarbon reservoirs are often stimulated using hydraulic fracturing techniques. Hydraulic fracturing consists of injecting a volume of fracturing fluid through created perforations and into the surrounding reservoir at such high pressures and rates that the reservoir rock in proximity to the perforations cracks open and extends outwardly in proportion to the injected fluid volume. This results in the creation of fractures that serve as a conduit for fluid within the reservoir, thus permitting hydrocarbon fluids to flow into the wellbore and then be produced at the surface. In operation, the success of the hydraulic fracturing process has a direct impact on the production characteristics of the hydrocarbon well. Specifically, the geometry, conductivity, dimensions, and/or extent of the hydraulic fractures affects the amount of hydrocarbon fluids that may be recovered from the reservoir.

With this in mind, hydraulic fractures in wells propagate according to the conditions in the subsurface. A system and method to propagate hydraulic fractures in a way that improves the efficiency of producing hydrocarbons is desirable.

SUMMARY OF THE INVENTION

An embodiment provided herein relates to a method for propagating hydraulic fractures in a reservoir. The method includes creating a low pressure region in an attractor well. The attractor well is proximate to an area in which hydraulic fractures are desired. The method also includes initiating a hydraulic fracturing operation at a treatment well so that a fracture network created by the hydraulic fracturing operation is drawn to propagate toward the low pressure region of the attractor well.

Another embodiment provided herein relates to a well system. The well system includes an attractor well having a low pressure region created therein. The attractor well is proximate to an area in which hydraulic fractures are desired. The well system also includes a treatment well at which a hydraulic fracturing operation is initiated so that a fracture network created by the hydraulic fracturing operation is drawn to propagate toward the low pressure region of the attractor well.

A further embodiment provided herein relates to a well system. The well system includes an attractor well having a low pressure region created therein. The attractor well is proximate to an area in which hydraulic fractures are desired. The well system also includes a treatment well at which a hydraulic fracturing operation is initiated so that a fracture network created by the hydraulic fracturing operation is drawn to propagate toward the low pressure region of the attractor well. The well system includes a computing system that calculates an aspect of the fracture network to provide an input to a subsequent hydraulic fracturing operation.

These and other features and attributes of the disclosed embodiments of the present techniques and their advantageous applications and/or uses will be apparent from the detailed description that follows.

BRIEF DESCRIPTION OF THE DRAWINGS

To assist those of ordinary skill in the relevant art in making and using the subject matter described herein, reference is made to the appended drawings, where.

Figure 1:
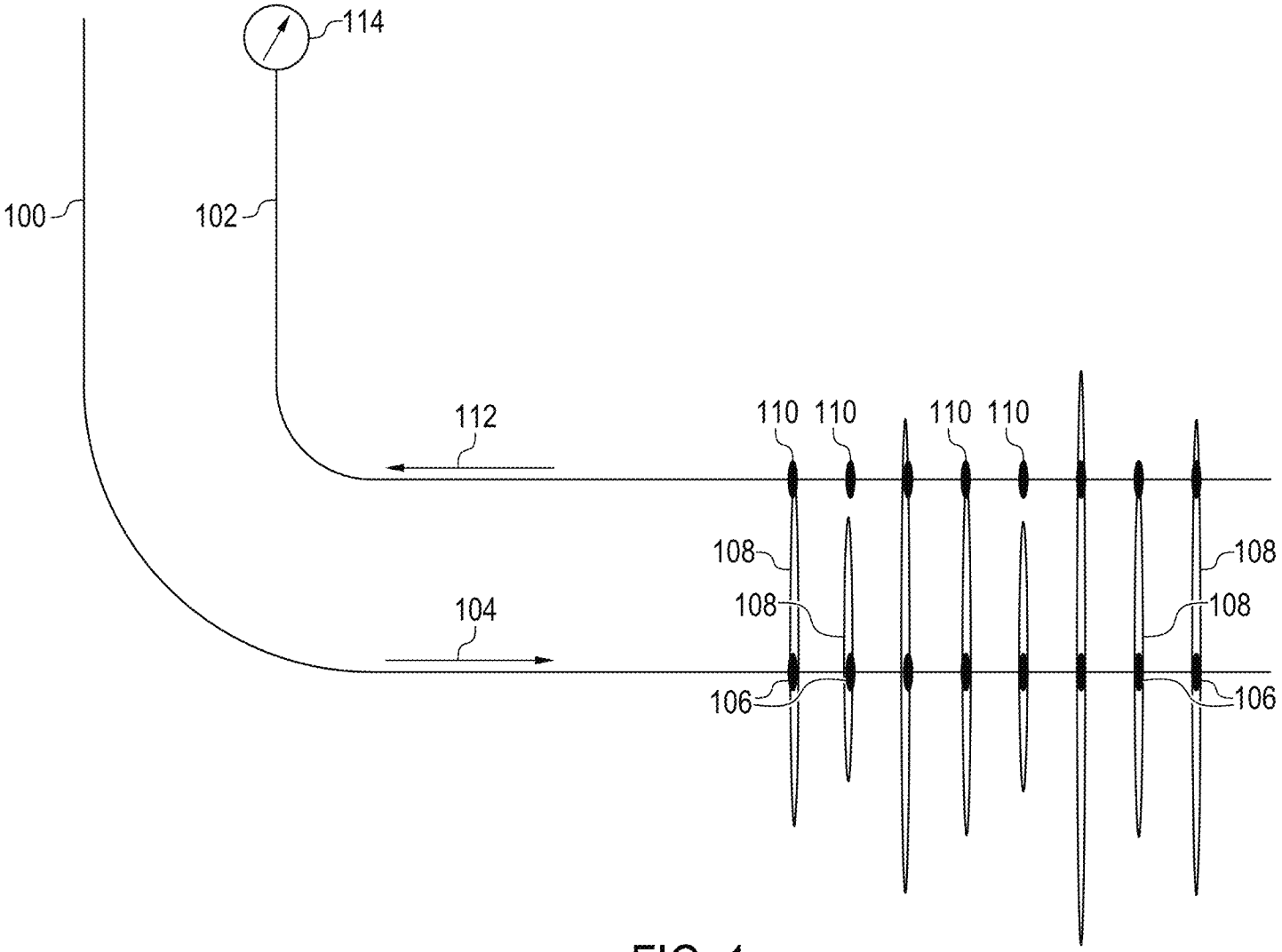
FIG. 1 is a simplified schematic view of a treatment well and an attractor well that may be utilized in accordance with the present techniques.

It should be noted that the figures are merely examples of the present techniques and are not intended to impose limitations on the scope of the present techniques. Further, the figures are generally not drawn to scale, but are drafted for purposes of convenience and clarity in illustrating various aspects of the techniques.

DETAILED DESCRIPTION OF THE PREFERRED EMBODIMENTS

In the following detailed description section, the specific examples of the present techniques are described in connection with preferred embodiments. However, to the extent that the following description is specific to a particular embodiment or a particular use of the present techniques, this is intended to be for exemplary purposes only and simply provides a description of the embodiments. Accordingly, the techniques are not limited to the specific embodiments described below, but rather, include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition those skilled in the art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the singular forms "a," "an," and "the" mean one or more when applied to any embodiment described herein. The use of "a," "an," and/or "the" does not limit the meaning to a single feature unless such a limit is specifically stated.

The term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "including," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the term "any" means one, some, or all of a specified entity or group of entities, indiscriminately of the quantity.

The phrase "at least one," when used in reference to a list of one or more entities (or elements), should be understood to mean at least one entity selected from any one or more of the entities in the list of entities, but not necessarily including at least one of each and every entity specifically listed within the list of entities, and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently, "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, the phrase "based on" does not mean "based only on," unless expressly specified otherwise. In other words, the phrase "based on" means "based only on," "based at least on," and/or "based at least in part on."

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure, or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "field" (sometimes referred to as an "oil and gas field" or a "hydrocarbon field") refers to an area including one or more hydrocarbon wells for which hydrocarbon production operations are to be performed to provide for the extraction of hydrocarbon fluids from a corresponding subterranean formation.

The term "fracture" refers to a crack or surface of breakage induced by an applied pressure or stress within a subterranean formation.

As used herein, the term "fluid influx sensor" is used to refer to any suitable type of measurement device that is capable of detecting (either directly or indirectly) the influx of fluid into a wellbore, and the term "fluid influx data" is used to refer to data that are measured using such a fluid influx sensor. As an example, the fluid influx sensor described herein may include (but is not limited to) a pressure transducer, where such pressure transducer may include any type of pressure gauge or other pressure-measuring device that is coupled to the fluid column within a wellbore and is configured to measure pressure data corresponding to the wellbore. As another example, the fluid influx sensor described herein may additionally or alternatively include (but is not limited to) a fiber optic cable that is configured to measure strain data corresponding to the wellbore. As another example, the fluid influx sensor described herein may additionally or alternatively include (but is not limited to) any other suitable type of measurement device that is configured to measure data relating to the dimensions (e.g., the circumference) of the casing within the wellbore and/or data relating to the fluid level inside the wellbore, for example. Generally speaking, the fluid influx data described herein include data that can be used to directly or, more preferably, indirectly determine one or more parameters corresponding to one or more hydraulic connections between multiple hydrocarbon wells, as described herein.

The term "hydraulic fracturing" refers to a process for creating fractures (also referred to as "hydraulic fractures") that extend from a wellbore into a reservoir, so as to stimulate the flow of hydrocarbon fluids from the reservoir into the wellbore. A fracturing fluid is generally injected into the reservoir with sufficient pressure to create and extend multiple fractures within the reservoir, and a proppant material is used to "prop" or hold open the fractures after the hydraulic pressure used to generate the fractures has been released.

As used herein, the term "surface" refers to the uppermost land surface of a land well, or the mud line of an offshore well, while the term "subsurface" (or "subterranean") generally refers to a geologic strata occurring below the earth's surface. Moreover, as used herein, "surface" and "subsurface" are relative terms. The fact that a particular piece of equipment is described as being on the surface does not necessarily mean it must be physically above the surface of the earth but, rather, describes only the relative placement of the surface and subsurface pieces of equipment. In that sense, the term "surface" may generally refer to any equipment that is located above the casing strings and other equipment that is located inside the wellbore. Moreover, according to embodiments described herein, the terms "downhole" and "subsurface" are sometimes used interchangeably, although the term "downhole" is generally used to refer specifically to the inside of the wellbore.

The term "wellbore" refers to a borehole drilled into a subterranean formation. The borehole may include vertical, deviated, highly deviated, and/or horizontal sections. The term "wellbore" also includes the downhole equipment associated with the borehole, such as the casing strings, production tubing, gas lift valves, and other subsurface equipment. Relatedly, the term "hydrocarbon well" (or simply "well") includes the wellbore in addition to the wellhead and other associated surface equipment.

The present techniques relate to systems and methods to alter the conditions in the subsurface to change the fracture propagation and proppant transport in the resulting fractures. Moreover, the present techniques facilitate the propagation of fractures to improve the productivity of hydrocarbon resources. The fracture propagation techniques described herein provide for the injection of fracturing fluid into a treatment well that is in the vicinity of another well referred to herein as an attractor well.

According to the hydraulic fracture propagation techniques described herein, the treatment well and the attractor well are typically located in the same field or in adjacent fields. Moreover, the treatment well and the attractor well are configured such that one or more hydraulic fractures initiated within a particular stage of the treatment well are capable of establishing one or more hydraulic connections via propagation of the hydraulic fracture(s) through the subsurface region in the field. In various embodiments, such hydraulic connections are provided through hydraulic communication between the perforations (and corresponding hydraulic fractures).

Moreover, in some embodiments, the configuration of the treatment well and the attractor well(s) is specifically controlled to enable efficient implementation of the present techniques. In such embodiments, this may include drilling the treatment wellbore and the attractor wellbore such that the wellbores follow approximately the same path within the subsurface region, while being vertically and/or horizontally separated from each other by some predetermined offset.

In addition, in some such embodiments, the perforations within each stage (or at least a portion of the stages) may approximately line up between the treatment well and attractor well (or may be offset by some predetermined amount or within some predetermined range). Furthermore, in some such embodiments, the present techniques may include setting up clusters of perforations of variable lengths, skipping portions of the wellbore(s), or even drilling dedicated wells to specifications. However, it should also be noted that the present techniques can be performed without any preplanning regarding the configuration of the treatment well and the attractor well. In general, the present techniques can be applied for any multi-well configuration in which one or more hydraulic fractures are capable of propagating within the field.

In some embodiments, the treatment well described herein has not been previously hydraulically fractured. For example, the treatment well may be entirely (or partially) perforated but not yet hydraulically fractured. In other embodiments, the treatment well has been hydraulically fractured for one or more previous stages, but not for the stage that is being monitored. In yet other embodiments, the entire treatment well (or some substantial portion thereof) has already undergone a hydraulic fracturing operation.

In various embodiments, hydraulic fracture(s) are first initiated at the treatment well, and such hydraulic fracture(s) are used to establish hydraulic communication between the treatment well and the attractor well (i.e., by providing one or more hydraulic connections between the two wells). One or more fluid influx sensors (which may be located downhole and/or at the surface) may then used to measure the response in the attractor well, and the measured fluid influx data are used to determine one or more parameters relating to the hydraulic connection(s) between the two wells, such as, for example, the arrival of the hydraulic fractures at the attractor well.

Examples of additional parameters that may be determined using such fluid influx data include the fracture growth patterns within the subsurface region, the number of hydraulic fractures, the number of hydraulic connections between the wellbores, the azimuth of one or more of the hydraulic fractures, the intensity of the hydraulic connection(s) between the treatment well and the attractor well, the conductivity of one or more of the hydraulic fractures, the degree of isolation integrity in the attractor well and/or the distribution of proppant within the fracture network. Moreover, in some embodiments, the fluid influx data may be used to derive interpretations regarding changes in the created fracture system over time, including changes in the fracture growth patterns, the well connectivity, and/or other early insights or indicators regarding future production potential. In some embodiments, the present techniques may enable the fluid influx data to be coupled with a hydraulic fracture model to provide more detailed information regarding the subsurface region. Furthermore, in some embodiments, the fluid influx data may be used to determine information relating to post-shut-in fracture patterns and trends, including the continuity and/or conductivity of the hydraulic connection(s) between the wellbores subsequent to shut-in.

The fracture propagation techniques described herein can be advantageously applied to any subsurface hydraulic fracturing scenarios involving multiple wells that are within relatively close proximity to each other. Moreover, the present techniques may be applied to configurations of one or more treatment wells being used to propagate fractures in the direction of one or more attractor wells.

Figure 2:
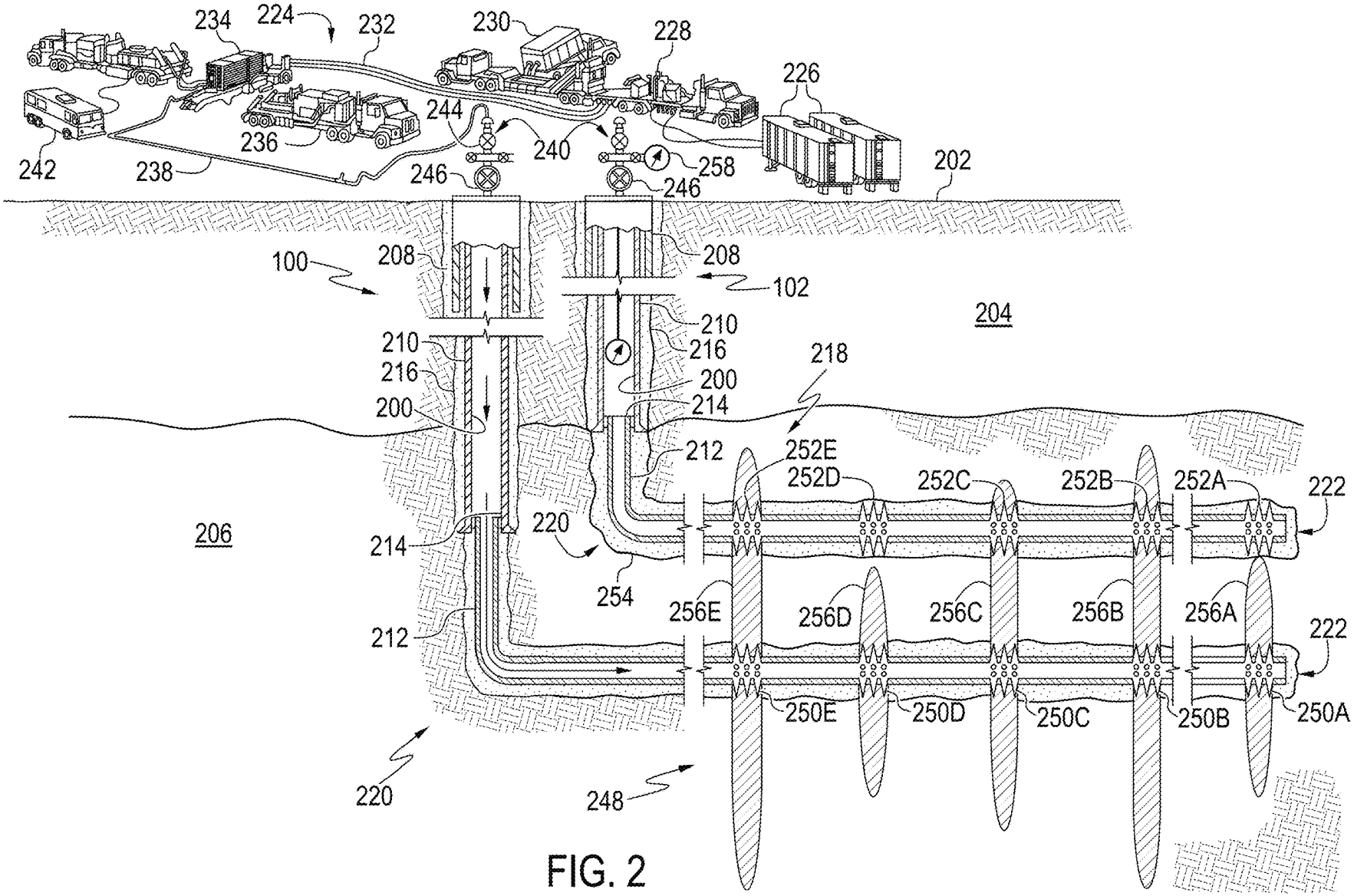
FIG. 2 is a schematic view of an exemplary embodiment of the treatment well and the attractor well of FIG. 1 shown in the context of a reservoir.

Turning now to the figures, FIGS. 1 and 2 provide examples of wells that may be utilized to perform the techniques described herein. Within such figures, elements that serve a similar (or at least substantially similar) purpose may be labeled with like numbers. Moreover, those skilled in the art will appreciate that the schematic views of FIGS. 1 and 2 are not intended to indicate that the well(s) described herein are to include all of the components shown in the figures in every embodiment, or that the well(s) are limited to only such components. Rather, any number of components may be added to, or omitted from, the well(s) without departing from the scope of the present techniques.

FIG. 1 is a simplified schematic view of a treatment well and an attractor well that may be utilized in accordance with the present techniques, while FIG. 2 is a schematic view of an exemplary embodiment of the treatment well and the attractor well of FIG. 1 shown in the context of a reservoir. In other words, FIG. 2 is a more detailed illustration of examples of components/structures that may be included in the wells shown in FIG. 1.

Turning first to FIG. 1, a treatment well 100 and an attractor well 102 are provided. In various embodiments, the treatment well 100 is a producer well or any other suitable type of hydrocarbon well that is configured to undergo a hydraulic fracturing process. Moreover, in various embodiments, the attractor well 102 may be a separate producer well, a dedicated attractor well, or any other suitable type of well that is offset from the treatment well 100 and is configured to measure fluid influx data according to the present techniques. As described above, according to embodiments described herein, the attractor well 102 may be a well that has not yet undergone a hydraulic fracturing process.

In an exemplary embodiment, fracturing fluid is injected into the formation 204 via the treatment well 100, as indicated by arrow 104. A section of the attractor well 102 is open to the subsurface via previously created fractures or any other means, such as a slotted liner or perforations, to give two examples.

A low pressure region is created in the attractor well 102. Practitioners will appreciate that the low pressure region may extend from within the wellbore of the attractor well 102 to an area adjacent to the wellbore of the attractor well 102. For example, the low pressure region may extend from at least a portion of the wellbore of the attractor well 102 into adjacent fractures and rock matrix. Moreover, the low pressure region is not necessarily contained entirely within the wellbore of the attractor well 102. Exemplary techniques that may be used to create the low pressure region include placing the attractor well 102 into production and/or flowback during the stimulation of the corresponding sections of the treatment well 100. Alternatively, the low pressure region in the attractor well 102 could be artificially created such as by employing a downhole pump in the attractor well 102 or by reducing a hydrostatic fluid column in the attractor well 102 to surface via gas injection.

The pressure sink or low pressure region in the attractor well 102 can act to direct the propagation of a fracture network and/or transport of proppant in created fractures toward the pressure sink or low pressure region. As the simulation fluid/slurry from the treatment well 100 approaches or intersects the attractor well 102, the pressure sink or low pressure region results in changes in the flow field in the created fractures and induces changes in the geometry of created fractures as well as changes in the transport of proppant in the created fractures. In particular, more proppant may transport from the treatment well 100 toward any producing attractor well 102 relative to other directions. The resulting scenario exhibits significant advantages for the treatment well 100 in which the percentage of propped area in the fractures is increased. Increased proppant distribution results in improved estimated ultimate recovery (EUR). Moreover, the increased distribution of proppant provided by the present techniques may allow reduction of the number of wells per section within a reservoir.

In an exemplary embodiment, creation of the low pressure region in the attractor well 102 is done to create a specific magnitude of pressure depletion for the purpose of propagating the fracture network created by the treatment well 100 and to increased propped square feet resulting from the fracture network. As one example, the attractor well 102 may be placed into production for a period of time to create the pressure sink around the attractor well 102. After being produced for the period of time, the attractor well 102 may be shut in during the stimulation by the treatment well 100 to avoid getting sand into the attractor well 102. In this manner, the low pressure region in the attractor well 102 is used in a designed manner to pull fractures in a particular direction for a prescribed period of time and at a designed magnitude.

As shown in FIG. 1, at least a portion of hydraulic fractures 108 provide one or more hydraulic connections between the treatment well 100 and the attractor well 102, thus establishing hydraulic communication between the two wells. Specifically, in various embodiments, such hydraulic fractures 108 establish hydraulic connections between the perforations within the particular stage of the treatment well 100 and the perforations 110 within the corresponding stage of the attractor well 102. Moreover, in various embodiments, the initiation of such hydraulic connections enables proppant to travel through the fluid column within the wellbore of the attractor well 102, as indicated by arrow 112, and to be measured via a measuring device 114 that is coupled to the fluid column within the wellbore of the attractor well 102.

Those skilled in the art will appreciate that, while such measuring device 114 is depicted in FIG. 1 as being at or near the surface or wellhead of the attractor well 102, the measuring device 114 may additionally or alternatively be positioned anywhere within the wellbore itself, including within proximity to the stage of interest. Furthermore, in some embodiments, multiple measuring devices 114 (e.g., potentially one or more arrays of measuring devices 114) may be used. Furthermore, it should be noted that, while a measuring device is utilized as the fluid influx sensor in the exemplary embodiment shown in FIG. 1, other types of fluid influx sensors may additionally or alternatively be utilized, depending on the details of the particular embodiment. For example, in some embodiments, the fluid influx sensor(s) may include one or more fiber optic cables that are configured to measure temperature, acoustic energy or strain data corresponding to the wellbore of the attractor well 102. Further, the pressure at the low pressure region of the attractor well 102 may be directly measured.

According to the embodiment shown in FIG. 1, the data recorded by the measuring device 114 (and/or other type(s) of fluid influx sensor(s)) are used to determine one or more parameters corresponding the hydraulic connection(s) between the two wells 100 and 102. Such parameters may include (but are not limited to) the arrival of proppant at the attractor well 102, the arrival of fractures at the attractor well 102, the fracture growth patterns within the subsurface region, the total (or approximate) number of hydraulic fractures 108, the total (or approximate) number of hydraulic connections between the wells 100 and 102, the azimuths of the hydraulic fractures 108, the intensities of the hydraulic connections between the wells 100 and 102, the conductivities of the hydraulic fractures 108, and/or the degree of isolation integrity in the attractor well 102.

In some embodiments, fluid influx data may be used to derive interpretations regarding changes in the created fracture system over time, including changes in the fracture growth patterns, the well connectivity, and/or other early insights or indicators regarding production operations. In some embodiments, the fluid influx data are also coupled with a hydraulic fracture model to provide more detailed information regarding the subsurface region. Furthermore, in some embodiments, the fluid influx data are used to determine information relating to post-shut-in fracture patterns and trends, including the post-shut-in continuity and/or conductivity of the hydraulic connection(s) between the wells 100 and 102.

According to the present techniques, it may be desirable to shut off one or more connections established between the treatment well 100 and additional wells. This would allow reducing communication between the wells. Moreover, it may be desirable to reduce one or more dominant connections between the treatment well 100 and the attractor well 102. Reducing connections in this manner may desirably prevent loss of energy through those dominant fractures in favor of growing other smaller fractures. To accomplish this, it may be desirable to shut off the injection into select fractures, which could otherwise be done with diverters, in order to promote growth of the other fractures. The measurements in the attractor well 102 can help determine if this is needed.

Turning now to FIG. 2, the treatment well 100 and the attractor well 102 each define a corresponding wellbore 200 that extends from a surface 202 into a formation 204 within the subsurface. The formation 204 may include several subsurface intervals, such as a hydrocarbon-bearing interval that is referred to herein as a reservoir 206. In some embodiments, the reservoir 206 is an unconventional, tight reservoir, meaning that it has regions of low permeability. For example, the reservoir 206 may include tight sandstone, tight carbonate, shale gas, coal bed methane, tight oil, and/or tight limestone.

Each wellbore 200 is completed by setting a series of tubulars into the formation 204. These tubulars may include several strings of casing, such as a surface casing string 208, an intermediate casing string 210, and a production casing string 212, which is sometimes referred to as a "production liner." In some embodiments, additional intermediate casing strings (not shown) are also included to provide support for the walls of the wellbore 200. According to the embodiment shown in FIG. 2, the surface casing string 208 and the intermediate casing string 210 are hung from the surface 202, while the production casing string 212 is hung from the bottom of the intermediate casing string 210 using a liner hanger 214.

As an alternative to the use of the liner hanger 214, production casing may be run from the surface to the total depth of the well. This alternative may desirably permit the use of fiber optics and other sensors in a lateral portion of the well to perform measurements, as described herein.

The surface casing string 208 and the intermediate casing string 210 are set in place using cement 216. The cement 216 isolates the intervals of the formation 204 from the wellbore 200 and each other. The production casing string 212 may also be set in place using cement 216, as shown in FIG. 2. Alternatively, the wellbore 200 may be set as an open-hole completion, meaning that the production casing string 212 is not set in place using cement.

The exemplary wellbores 200 shown in FIG. 2 are both completed horizontally (or laterally). A lateral section of each wellbore 200 is shown at 218. Each lateral section 218 has a heel 220 and a toe 222 that extends through the reservoir 206 within the formation 204.

In various embodiments, because the reservoir 206 is an unconventional, tight reservoir, a hydraulic fracturing process is performed to allow hydrocarbon fluids to be economically produced from the reservoir 206. As shown in FIG. 2, the hydraulic fracturing process may utilize an extensive amount of equipment at a well site 224 located at the surface 202. The equipment may include fluid storage tanks 226 to hold fracturing fluid, such as slickwater, and blenders 228 to blend the fracturing fluid with other materials, such as proppant 230 and other chemical additives, forming a low-pressure slurry. The low-pressure slurry 232 may be run through a treater manifold 234, which may use pumps 236 to adjust flow rates, pressures, and the like, creating a high-pressure slurry 238. According to embodiments described herein, the high-pressure slurry 238 may be pumped down the wellbore 200 of the treatment well 100 via a corresponding wellhead 240 and used to fracture the rocks in the reservoir 206. Moreover, a mobile command center 242 may be used to control the hydraulic fracturing process, as well as the inter-well parameter detection techniques described herein.

Each wellhead 240 may include any arrangement of pipes and valves for controlling the corresponding well 100 or 102. In some embodiments, the wellhead 240 is a so-called "Christmas tree." A Christmas tree is typically used when the subsurface formation 204 has enough in-situ pressure to drive hydrocarbon fluids from the reservoir 206, up the corresponding wellbore 200, and to the surface 202. The illustrative wellhead 240 includes a top valve 244 and a bottom valve 246. In some contexts, these valves are referred to as "master valves." Moreover, in various embodiments, the wellhead 240 also couples the corresponding hydrocarbon well 100 or 102 to other equipment, such as equipment for running a wireline (not shown) into the corresponding wellbore 200. In some embodiments, the equipment for running the wireline into the wellbore 200 includes a lubricator (not shown), which may extend as much as 75 feet above the wellhead 240. In this respect, the lubricator must be of a length greater than the length of a bottomhole assembly (BHA) (not shown) attached to the wireline to ensure that the BHA may be safely deployed into the wellbore 200 and then removed from the wellbore 200 under pressure.

While there are several different methods for hydraulically fracturing the reservoir 206 via the treatment well 100 according to embodiments described herein, a hydraulic fracturing process referred to as a "plug-and-perforation process" is described with respect to FIG. 2. During the plug-and-perforation process, a specialized BHA, referred to as a "plug-and-perf assembly," (not shown) is run into the wellbore 200 of the treatment well 100 via the wireline connected to the corresponding wellhead 240. The wireline provides electrical signals to the surface 202 for depth control. In addition, the wireline provides electrical signals to perforating guns (not shown) included within the plug-and-perf assembly. The electrical signals may allow the operator within the mobile command center 242 to cause the charges within the perforating gun to fire, or detonate, at a desired stage or depth within the wellbore 200.

In operation, the perforating gun is run into the first stage 248 of the treatment well 100, which is located near the toe 222 of the lateral section 218. The perforating gun is then detonated to create a first perforation cluster 250A through the production casing string 212 and the surrounding cement 216. In operation, the perforating gun typically forms one perforation cluster by shooting 12 to 18 perforations at one time, over a 1- to 3-foot region, with each perforation being approximately 0.3 to 0.5 inches in diameter. The perforating gun is then typically moved uphole 10 to 100 feet, and a second perforating gun is used to form a second perforation cluster 250B. This process of forming perforation clusters is repeated another 1 to 18 times to create multiple perforation clusters within a single stage. Therefore, while only five perforation clusters 250A, 250B, 250C, 250D, and 250E are depicted for the first stage 248 of the treatment well 100, each stage of the treatment well 100 may include a total of around 3 to 20 perforation clusters, with each perforation cluster being spaced around 10 to 100 feet apart, for example.

Furthermore, according to embodiments described herein, a similar process may be used to create perforation clusters 252A, 252B, 252C, 252D, and 252E within a corresponding stage 254 of the attractor well 102. In some embodiments, the perforation clusters 252A-E within the wellbore 200 of the attractor well 102 are designed to approximately align with the perforation clusters within the wellbore 200 of the treatment well 100. For example, the perforation clusters may be designed to be offset to a certain extent or to be within a certain amount of distance from each other. However, in other embodiments, the techniques described herein are performed without pre-designing or altering the treatment well 100 or the attractor well 102 to include perforation clusters that align (or approximately align).

In various embodiments, once the perforation clusters 250A, 250B, 250C, 250D, and 250E are formed within the first stage of the treatment well 100, the plug-and-perf assembly is removed from the wellbore 200, and the high-pressure slurry 238 of fracturing fluid is pumped down the wellbore 200, through the perforations within the perforation clusters 250A-E, and into the surrounding reservoir 206, forming corresponding sets of fractures 256A, 256B, 256C, 256D, and 256E within the reservoir 206.

As an alternative to perforating the production casing 212, the connection to the reservoir 206 could be created by downhole sleeves or rupture discs, which are activated by a variety of mechanisms not involving perforating. This type of completion can be used in the treatment well 100 and/or the attractor well 102.

According to embodiments described herein, as hydraulic fractures 256A-E are formed, at least a portion of the fractures reach or extend to the perforation clusters 252A-E corresponding to the attractor well 102 (and/or to one or more open ports, sleeves, and/or slots corresponding to the attractor well 102). As a result, such hydraulic fractures 256A-E establish hydraulic connections between the perforation clusters 250A-E and 252A-E of the two wells 100 and 102, respectively. As described herein, such hydraulic connections provide a means of hydraulic communication between the two wells 100 and 102, thus enabling one or more fluid influx sensors 258 (e.g., a measuring device according to the exemplary embodiment shown in FIG. 2) at the attractor well 102 to measure data corresponding to the formation of such hydraulic fractures 256A-E. Such data are then used to determine parameters relating to the hydraulic connection(s) between the wells 100 and 102, including parameters relating to the hydraulic fractures 256A-E originating from the treatment well 100, as described herein.

According to the present techniques, it is possible that the low pressure region at the attractor well 102 could influence the fracture propagation from the treatment well 100 before any fracture reaches the attractor well 102 via pressure transmission through the rock. In addition, if the attractor well 102 had fractures associated with it (whether pre-existing "natural fractures" or hydraulically induced), the fractures propagating from the treatment well 100 could be affected when the fractures from the treatment well 100 intersect with those pre-existing fractures or even if they approach to them.

According to the embodiment shown in FIG. 2, the fluid influx sensor 258 (e.g., the pressure transducer) is coupled to the fluid column within the wellbore 200 of the attractor well 102 via direct connection with the wellhead 240. However, one or more fluid influx sensors 258 (or one or more arrays of fluid influx sensors 258) may be connected to the wellbore 200 in any suitable manner and/or may be positioned at any number of different locations, including inside the wellbore 200 and/or at the surface 202, depending on the details of the particular implementation.

Those skilled in the art will appreciate that this inter-well parameter detection process may be performed for each stage of the treatment well 100 (or for any subset thereof) and may be used to guide or optimize the hydraulic fracturing operations and/or the overarching hydrocarbon production operations. For example, the detected parameters that are output from the process may be used to generate a well spacing plan that is tailored to the field of interest (i.e., the formation 204 within the subsurface region of interest), and the well spacing plan may then be physically implemented in the field (i.e., by drilling (or causing the drilling of) multiple wells within the field according to such well spacing plan).

According to the present techniques, multiple attractor wells 102 could be used at the same time to pull fluid and/or proppant away from the treatment well 100 in multiple predetermined directions. This technique of using multiple wells may create a larger overall final propped fracture geometry. The process of the present techniques may be continued for multiple stages in the treatment well. After the fracturing operation is completed, all wells, including the additional wells, may be put on production.

As explained below, the present techniques may be used for diverting (i.e., "pulling") fractures away from regions of depletion and improving the recovery potential of the whole system-see illustrations below. Note that this is different from injecting into and pressurizing the attractor well 102 in order to "push" a fracture in the opposite direction, which may be referred to as preloading. The present techniques also have potential applicability for non-oil and gas subsurface scenarios such as in geothermal systems.

FIGS. 3A-D are schematic illustrations showing a gun barrel view of the reservoir 206 including treatment wells and fracture zones showing the spread of hydraulic fractures therein. The present technological innovation exploits the knowledge that operating an attractor well 102 in production mode while hydraulic fracturing is being performed through a treatment well 100 in the vicinity will have the effect of migrating the fracture pattern toward the attractor well 102. By exploiting this knowledge, fracture patterns may be directed such that production of the wells in the reservoir 206 may be increased.

Figure 3A:
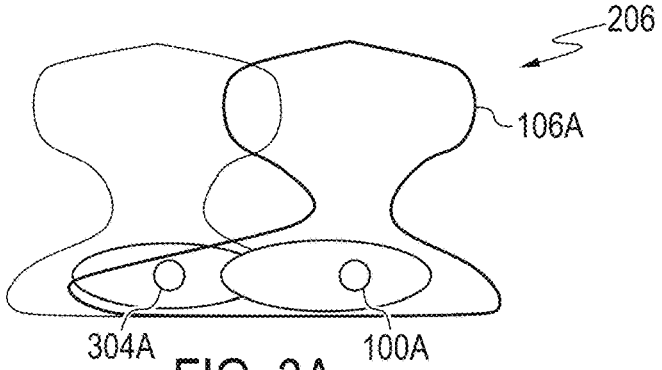
FIGS. 3A-D are schematic illustrations showing a gun barrel view of a reservoir including treatment wells and fracture zones showing the spread of hydraulic fractures therein according to an exemplary embodiment of the present techniques.

FIG. 3A shows a gun barrel view of a portion of the reservoir 206 that is located in the same bench. A treatment well 100A is being used to perform hydraulic fracturing. A producing well 304A is in the vicinity of the treatment well 100A. The producing well 304A may have been producing for some time, causing a partial depletion in hydrocarbon resources in the reservoir 206.

In the scenario shown in FIG. 3A, there is no attractor well in the vicinity of the treatment well 100A. Moreover, the hydraulic fracturing operation depicted in FIG. 3A is not performed in accordance with the present techniques because an attractor well is not being used.

The hydraulic fracturing operation causes a fracture zone 106A to be formed in the formation 204 of the reservoir 206. FIG. 3A shows the spread of the fracture zone 106A without the use of an attractor well. As depicted in FIG. 3A, the fracture zone 106A spreads according to the geological make-up of the formation 204, without the influence of an attractor well. In this manner, the fracture zone 106A spreads into the region of the producing well 304A, even though the region surrounding the producing well 304A is somewhat depleted.

Figure 3B:
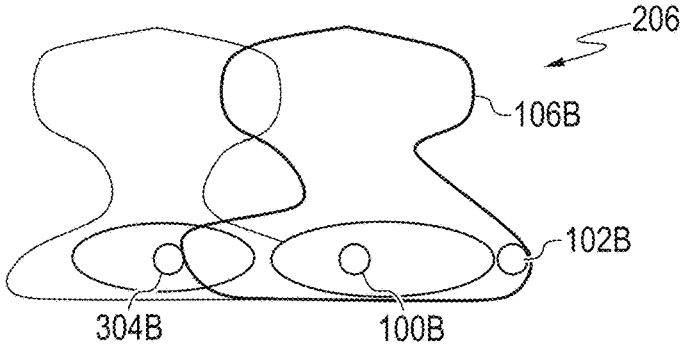

FIG. 3B shows a gun barrel view of a portion of the reservoir 206 that is located in the same bench. It should be noted that the treatment well 100 and the attractor well 102 will perform as described herein whether they are located in the same bench or not. Moreover, the treatment well 100 and the attractor well 102 may be located anywhere relative to each other, including directly next to each other or directly on top of each other. In either of these extreme cases, the present techniques act to pull the fractures away from the treatment well 100 toward the attractor well 102. If one of the wells is above the other, there may be more significant affect to the height of spreading fractures. If one of the wells is next to the other one, the length of spreading fractures may be more significantly affected. The practitioner of the present techniques will appreciate that both height and length are likely to be affected by the relative position of the wells, but the relative amounts of change to height and length of the fracture pattern will differ. For example, wells in the same bench will likely make longer fractures with less height growth, and the stacked well configuration is likely to result in the opposite.

The practitioner of the present techniques will appreciate that the presence of existing fractures between the treatment well 100 and the attractor well 102 may affect the degree of fracture propagation. Moreover, the presence of existing fractures may be a factor in placement of the attractor well 102.

A treatment well 100B is being used to perform hydraulic fracturing. A producing well 304B is in the vicinity of the treatment well 100B. The producing well 304B may have been producing for some time, causing a partial depletion in hydrocarbon resources in the reservoir 206.

An attractor well 102B is in the vicinity of the treatment well 100B. Moreover, the hydraulic fracturing operation depicted in FIG. 3B is being performed in accordance with the present techniques because an attractor well is being used. The attractor well 102B is in fluid communication with the treatment well 100B, as explained herein. Further, the attractor well 102B is producing.

The hydraulic fracturing operation depicted in FIG. 3B causes a fracture zone 106B to be formed in the formation 204 of the reservoir 206. FIG. 3B shows the spread of the fracture zone 106B being influenced by the use of the attractor well 102B. As depicted in FIG. 3B, the fracture zone 106B propagates in the direction of the attractor well 102B. In this manner, the fracture zone 106B spreads away from the region of the producing well 304B. This may improve production from the reservoir 206 because the region surrounding the producing well 304B is somewhat depleted. Moreover, the present technological innovation may be used to propagate the spread of a fracture zone to improve the efficiency of hydrocarbon production.

Figure 3C:
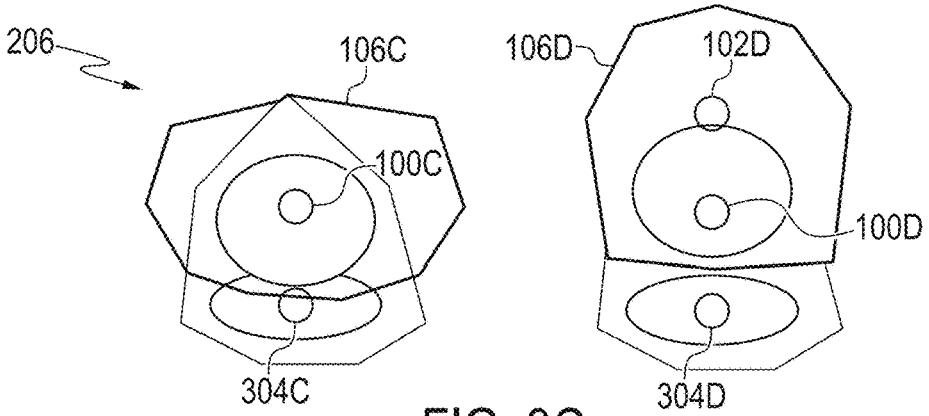

FIG. 3C shows a gun barrel view of a portion of the reservoir 206 that is located in different benches. As shown on the left side of FIG. 3C, a treatment well 100C is being used to perform hydraulic fracturing. A producing well 304C is in the vicinity of the treatment well 100C. The producing well 304C may have been producing for some time, causing a partial depletion in hydrocarbon resources in the reservoir 206.

In the scenario shown on the left side of FIG. 3C, there is no attractor well in the vicinity of the treatment well 100C. Moreover, the hydraulic fracturing operation depicted in the left side of FIG. 3C is not performed in accordance with the present techniques because an attractor well is not being used.

The hydraulic fracturing operation causes a fracture zone 106C to be formed in the formation 204 of the reservoir 206. FIG. 3C shows the spread of the fracture zone 106C without the use of an attractor well. As depicted in the left side of FIG. 3C, the fracture zone 106C spreads according to the geological make-up of the formation 204, without the influence of an attractor well. In this manner, the fracture zone 106C spreads into the region of the producing well 304C, even though the region surrounding the producing well 304C is somewhat depleted.

FIG. 3C also includes an example of the use of a treatment well in conjunction with an attractor well according to the present techniques. A treatment well 100D is being used to perform hydraulic fracturing. A producing well 304D is in the vicinity of the treatment well 100D. The producing well 304D may have been producing for some time, causing a partial depletion in hydrocarbon resources in the reservoir 206.

An attractor well 102D is in the vicinity of the treatment well 100D. Moreover, the hydraulic fracturing operation depicted in the right side of FIG. 3C is being performed in accordance with the present techniques because an attractor well is being used. The attractor well 102D is in fluid communication with the treatment well 100D, as explained herein. Further, the attractor well 102D is producing.

The hydraulic fracturing operation depicted on the right side of FIG. 3C causes a fracture zone 106D to be formed in the formation 204 of the reservoir 206. The right side of FIG. 3C shows the spread of the fracture zone 106D being influenced by the use of the attractor well 102D. As depicted on the right side of FIG. 3C, the fracture zone 106D propagates in the direction of the attractor well 102D. In this manner, the fracture zone 106D spreads away from the region of the producing well 304D. This may improve production from the reservoir 206 because the region surrounding the producing well 304D is somewhat depleted. Moreover, the present technological innovation may be used to propagate the spread of a fracture zone to improve the efficiency of hydrocarbon production.

Figure 3D:
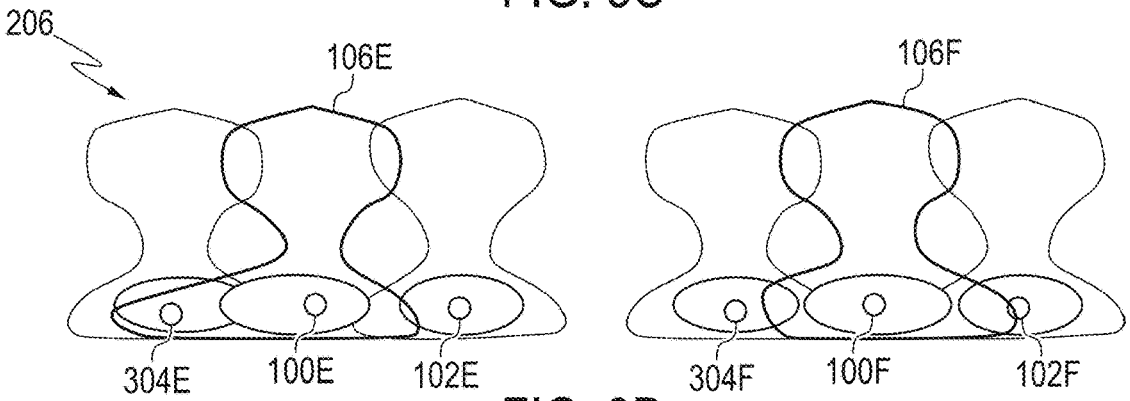

FIG. 3D shows a gun barrel view of a portion of the reservoir 206. In FIG. 3D, a fracturing operation was performed using an attractor well prior to performing a fracturing operation using a treatment well. The initial fracturing operation done using the attractor well provided a hydraulic connection between the treatment well and the attractor well, as explained herein.

As shown on the left side of FIG. 3D, subsequent to the performance of a fracturing operation using the attractor well, a treatment well 100E is being used to perform hydraulic fracturing. A producing well 304E is in the vicinity of the treatment well 100E. The producing well 304E may have been producing for some time, causing a partial depletion in hydrocarbon resources in the reservoir 206.

In the scenario shown on the left side of FIG. 3D, there is no attractor well in the vicinity of the treatment well 100E.

The well 102E has been previously fractured but is not operating as an attractor well in this scenario. Moreover, the hydraulic fracturing operation depicted in the left side of FIG. 3D is not performed in accordance with the present techniques because an attractor well is not being used.

The hydraulic fracturing operation causes a fracture zone 106E to be formed in the formation 204 of the reservoir 206. FIG. 3D shows the spread of the fracture zone 106E without the use of an attractor well. As depicted in the left side of FIG. 3E, the fracture zone 106E spreads according to the geological make-up of the formation 204, without the influence of an attractor well. In this manner, the fracture zone 106E spreads into the region of the producing well 304E, even though the region surrounding the producing well 304E is somewhat depleted.

FIG. 3C also includes an example of the use of a treatment well in conjunction with an attractor well according to the present techniques. A treatment well 100F is being used to perform hydraulic fracturing. A producing well 304F is in the vicinity of the treatment well 100F. The producing well 304F may have been producing for some time, causing a partial depletion in hydrocarbon resources in the reservoir 206.

An attractor well 102F is in the vicinity of the treatment well 100F. Moreover, the hydraulic fracturing operation depicted in the right side of FIG. 3C is being performed in accordance with the present techniques because an attractor well is being used. The attractor well 102F is in fluid communication with the treatment well 100F, as explained by the previous fracturing operation performed using the attractor well 102F. Further, the attractor well 102F is producing.

The hydraulic fracturing operation depicted on the right side of FIG. 3D causes a fracture zone 106F to be formed in the formation 204 of the reservoir 206. The right side of FIG. 3D shows the spread of the fracture zone 106F being influenced by the use of the attractor well 102F. As depicted on the right side of FIG. 3D, the fracture zone 106F propagates in the direction of the attractor well 102F. In this manner, the fracture zone 106F is drawn to spread away from the region of the producing well 304F. This may improve production from the reservoir 206 because the region surrounding the producing well 304F has been previously depleted. Moreover, the present technological innovation may be used to propagate the spread of a fracture zone to improve the efficiency of hydrocarbon production.

Figure 4:
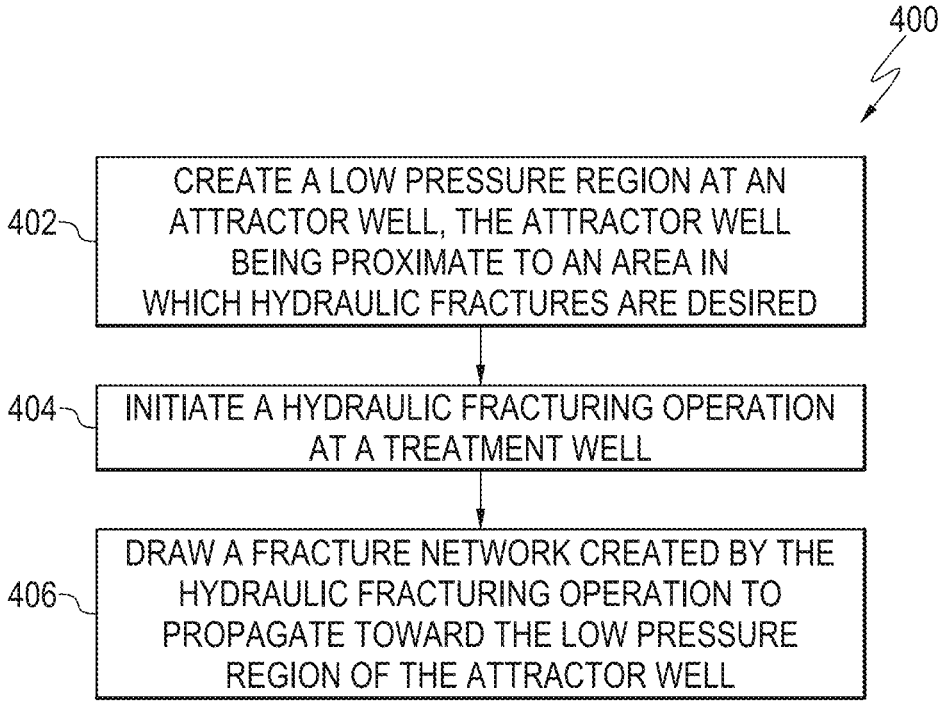
FIG. 4 is a process flow diagram of an exemplary method for propagating a fracture zone according to the present techniques.

FIG. 4 is a process flow diagram of an exemplary method 400 for propagating a fracture zone according to the present techniques. At block 402, a low pressure region is created at an attractor well 102. The attractor well 102 is proximate to an area in which hydraulic fractures are desired. The low pressure region may be created by placing the attractor well 102 into production. Alternatively, other methods could be used to create the low pressure region in the attractor well 102. For example, the pressure in the attractor well 102 could be artificially reduced such as by a downhole pump or by reducing the hydrostatic fluid column to surface via gas injection.

At block 404, a hydraulic fracturing operation is initiated at a treatment well 100. At block 406, the fracture network created by the hydraulic fracturing operation is drawn to propagate toward the low pressure region of the attractor well 102. As described herein, the low pressure region of the attractor well 102 provides a force to propagate the fracture pattern created by the fracturing operation toward the attractor well 102.

As noted herein, the attractor well 102 may have been in existence and producing hydrocarbons in the reservoir 206 or may have been drilled specifically for the purpose of functioning as an attractor well for a specific hydraulic fracturing operation. The location, degree of hydraulic connection to the treatment well 100 and level of production of the attractor well 102 may all be factors that can be controlled to facilitate propagation of a fracture network according to the present techniques. Moreover, the location of the attractor well 102 could be selected to maximize the propped surface area of the fracture network thus created. Such a fracture network may improve hydrocarbon production of the reservoir 206 by propagating the fracture network to an area that is more likely to result in the production of hydrocarbons and away from areas of relative depletion.

Figure 8:
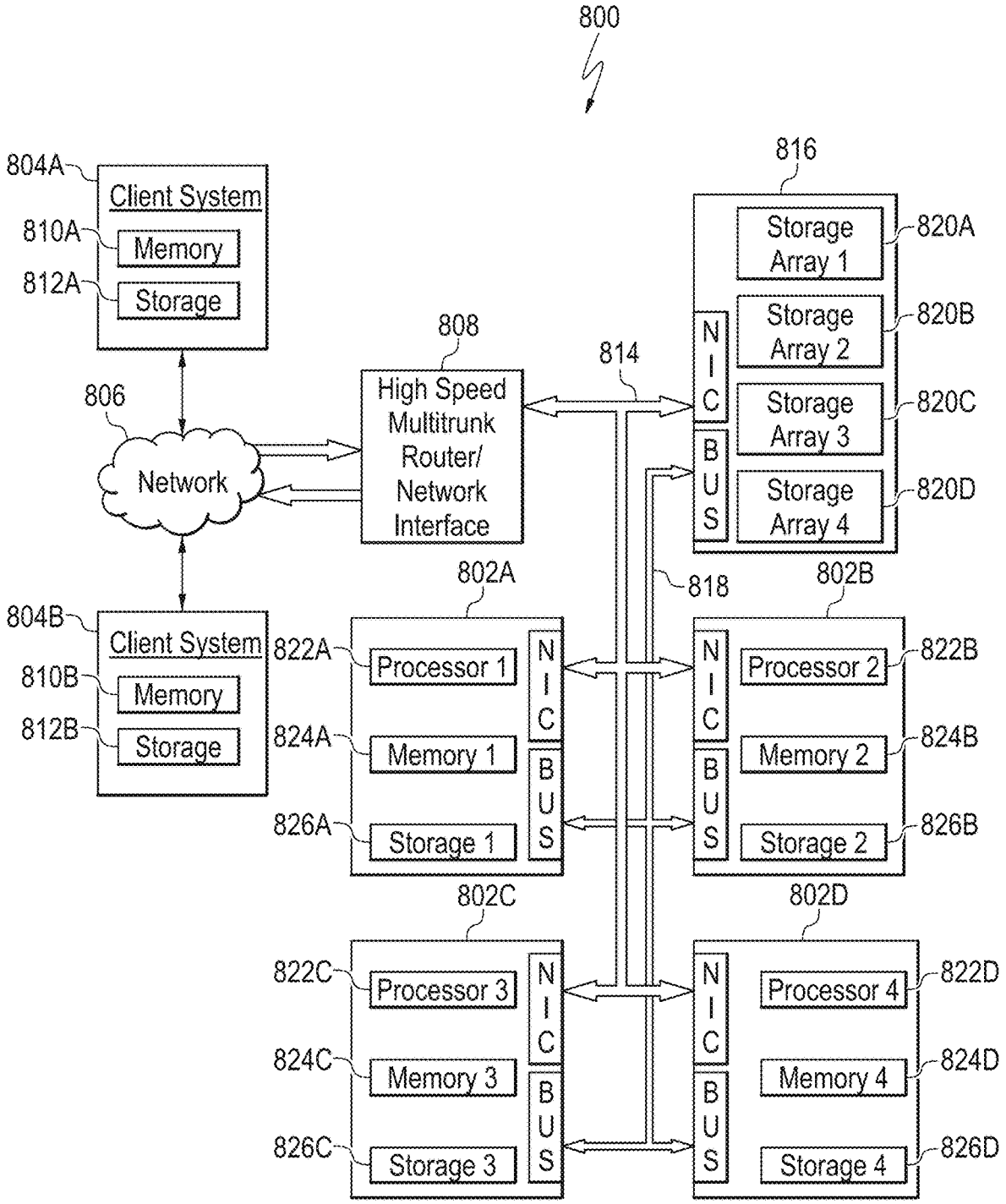
FIG. 8 is a block diagram of an exemplary cluster computing system that may be utilized to implement at least a portion of the present techniques.

The method 400 may be executed, at least in part, by one or more computing systems including one or more processors, such as the cluster computing system described with respect to FIG. 8, or any suitable variation(s) thereof. In some embodiments, such computing system(s) (or a portion of such computing systems) may be located at the mobile command center 242 described with respect to FIG. 2, which may form part of the same hydrocarbon field as the treatment well 100 and the attractor well 102 described herein.

Hydraulic connection data may be used to determine the fracture growth pattern of one or more of the hydraulic fractures, the number of hydraulic fractures that have arrived at the attractor well, the number of hydraulic connections between the treatment well and the attractor well, the azimuth of one or more of the hydraulic fractures, and/or the conductivity of one or more of the hydraulic fractures. Additionally or alternatively, in some embodiments, this includes determining the intensity of the hydraulic connection(s) between the treatment well and the attractor well, and/or the degree of isolation integrity in the attractor well. Additionally or alternatively, in some embodiments, this includes determining changes in at least a portion of the hydraulic fractures over time. Additionally or alternatively, in some embodiments, this includes determining the post-shut-in continuity and/or the post-shut-in conductivity of the hydraulic connection(s) between the treatment well and the attractor well. Moreover, in some embodiments, the method 400 also includes coupling the measured fluid influx data to a hydraulic fracture model that represents the fracture system corresponding to the hydraulic fractures.

Those skilled in the art will appreciate that the exemplary method 400 of FIG. 4 is susceptible to modification without altering the technical effect provided by the present techniques. In practice, the exact manner in which the method is implemented will depend, at least in part, on the details of the specific implementation. For example, in some embodiments, some of the blocks shown in FIG. 4 may be altered or omitted from the method 400 and/or new blocks may be added to the method 400. Moreover, in some embodiments, the method 400 is performed for multiple attractor wells that are located in the same field as the treatment well and/or in one or more adjacent fields.

Furthermore, in various embodiments, the hydraulic connection(s) are provided between perforations within the stage of the treatment well and perforations within a corresponding stage of the attractor well. In such embodiments, the method 400 may include configuring the treatment well and the attractor well such that the perforations within the stage of the treatment well and the perforations within the corresponding stage of the attractor well are offset by less than or equal to a predetermined distance in at least one direction. The creation of the fracture network between the treatment well 100 and the attractor well 102 as described herein may be used in the geothermal industry, as well as for hydrocarbon production.

In various embodiments, the method 400 further includes utilizing the detected parameters to generate a well spacing plan that is customized to the particular field. In such embodiments, the method 400 may further include executing the well spacing plan by drilling (or causing the drilling of) multiple wells within the field according to the specifications of the well spacing plan. Additionally or alternatively, the method 400 may include performing hydraulic fracturing operations and/or the overarching hydrocarbon production operations for the field in accordance with the detected parameters. This may include, for example, utilizing the detected parameters (including the data regarding hydraulic fracture arrival) to modify the hydraulic fracturing operations and/or the hydrocarbon production operations in any other suitable manner.

Figure 5:
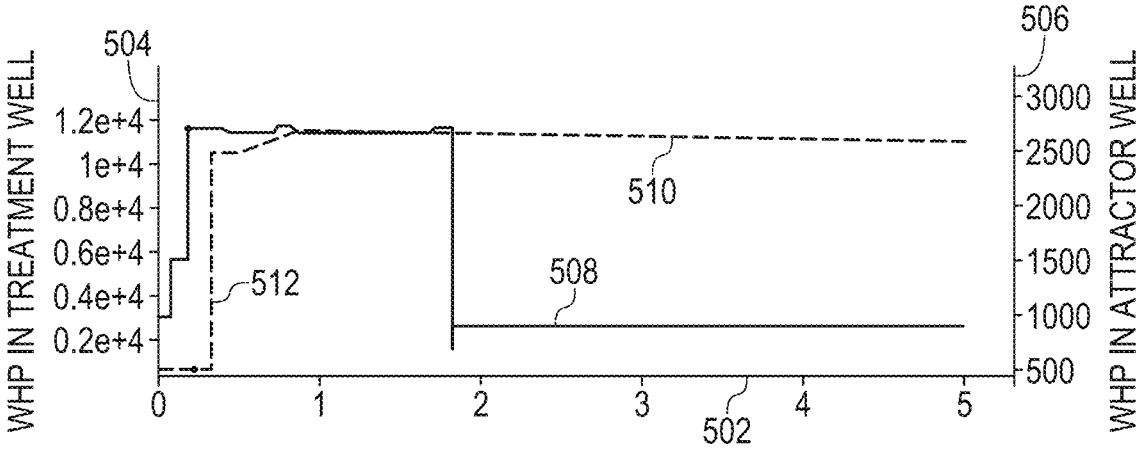
FIG. 5 is a graph showing an increase in pressure in an attractor well when hit by fractures from a treatment well in accordance with the present techniques.

FIG. 5 is a graph 500 showing an increase in pressure in an attractor well when hit by fractures from a treatment well in accordance with the present techniques. The graph 500 has an x-axis 502 representing time. A left y-axis 504 represents pressure at a wellhead of a treatment well. A right y-axis 506 represents pressure at a wellhead of an attractor well. In accordance with the present technological innovation, shortly after injection of fracturing fluid into the treatment well, the fracturing fluid may cause a fracture to hit a fracture zone of an attractor well.

Various traces are shown on the graph 500. The traces are representative of pressures at wellheads during performance of a hydraulic fracturing operation, as described herein.

The data shown in the graph 500 depicts a condition in which a base simulation is run with the attractor well being shut in and recording pressure of fracturing fluid exchange from the treatment well to the attractor well. In one example, a sensitivity simulation is run with the attractor well producing at a level of 1,000 barrels per day. The propped length of the fracture network may be monitored between simulations.

A treatment well trace 508 shows the pressure at the wellhead of a treatment well 100 during performance of a hydraulic fracturing operation. An attractor well trace 510 shows the pressure at the wellhead of an attractor well 102 during the performance of a hydraulic fracturing operation.

As shown by a sharp increase in pressure 512 on the attractor well trace 510, the pressure at the wellhead of the attractor well greatly increases shortly after a corresponding pressure increase in wellhead pressure of the treatment well, when the fracture zone from the treatment well 100 makes a hit on the perforated zone of the attractor well 102. This increase in pressure can result in the fracture zone of the treatment well being propagated in the direction of the attractor well, as described herein. As shown in the graph 500, the pressure at the wellhead of the attractor well maintains an elevated level even after the pressure at the wellhead of the treatment well is reduced.

The timing and magnitude of the response seen in the attractor well 102 can be used within a fracture model to predict the resulting created and propped fracture geometry. This information could be used to adjust treatment parameters for subsequent stages.

Figure 6:
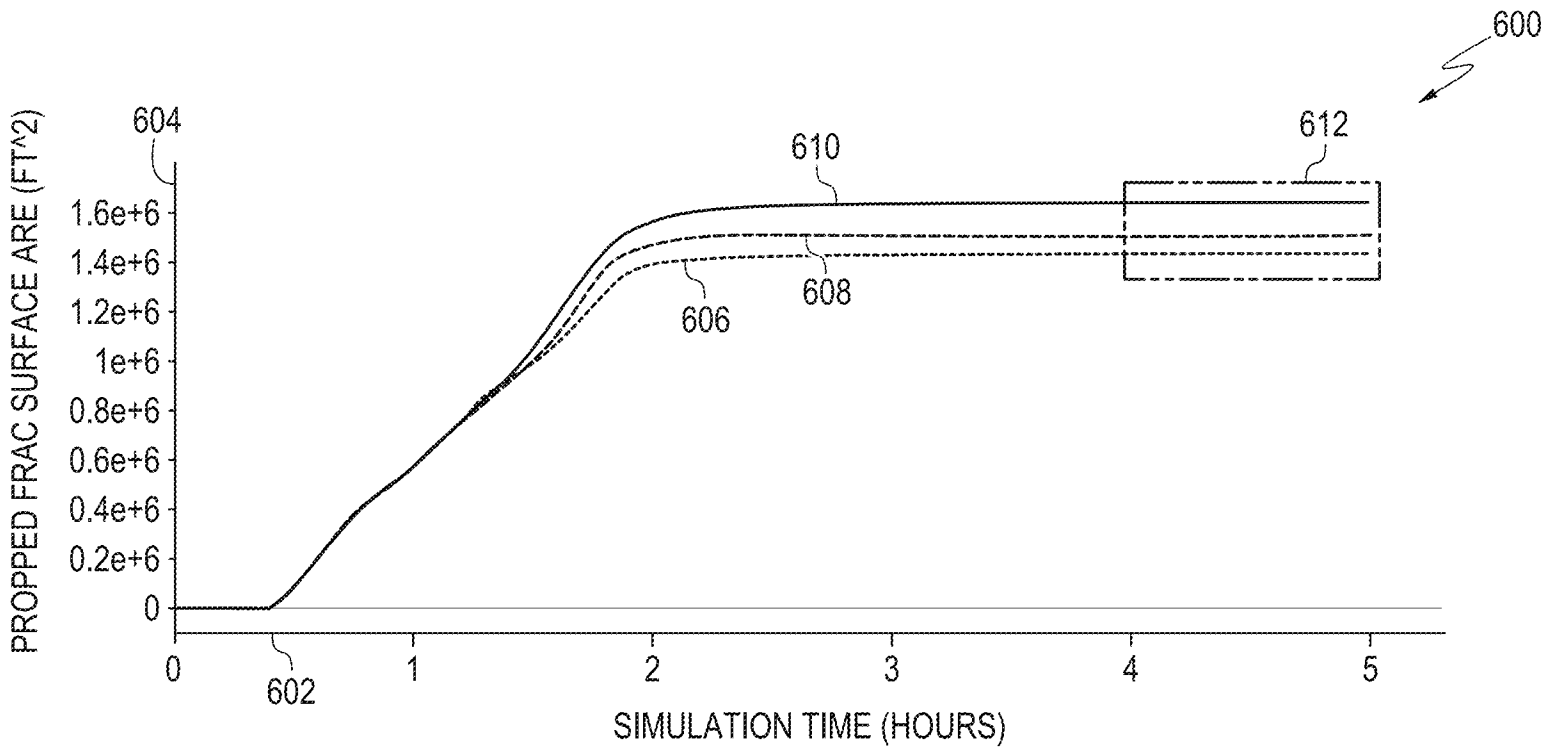
FIG. 6 is a graph showing a comparison of simulated propped fracture surface area for a number of fracturing operation scenarios, according to the present techniques.

FIG. 6 is a graph 600 showing a comparison of simulated propped fracture surface area for a number of fracturing operation scenarios, according to the present techniques. The graph 600 shows an x-axis 602, which represents time. A y-axis 604 represents propped fracture surface area in square feet. Moreover, the y-axis 604 represents the area of a propped surface area created by performing a fracturing operation.

A base scenario trace 606 shows the propped surface area resulting from a fracturing operation that does not use an attractor well 102, as described herein. A first attractor well trace 608 shows the extent of the propped surface area resulting from a fracturing operation employing an attractor well 102 that is producing at a rate of about 1,000 barrels per day (bpd). As shown by the first attractor well trace 608, the extent of the propped surface area created using an attractor well 102 is greater than the propped surface area obtained without the use of an attractor well 102.

Most of the change in propped surface area is observed after the treatment may be stopped. Additionally, the increase in propped surface area can be assumed to imply an increase in the recoverable hydrocarbon reserves of an isolated well. Placement of such attractor wells strategically can provide significant improvements in the economics of oil and gas assets.

A second attractor well trace 610 shows the extent of a propped surface area resulting from a fracturing operation employing an attractor well 102 that is producing at a rate of about 5,000 bpd. As shown by the second attractor well trace 610, the extent of the propped surface area created using an attractor well producing about 5,000 bpd is greater than the propped surface area obtained using an attractor well 102 producing at a rate of about 1,000 bpd.

Figure 7:
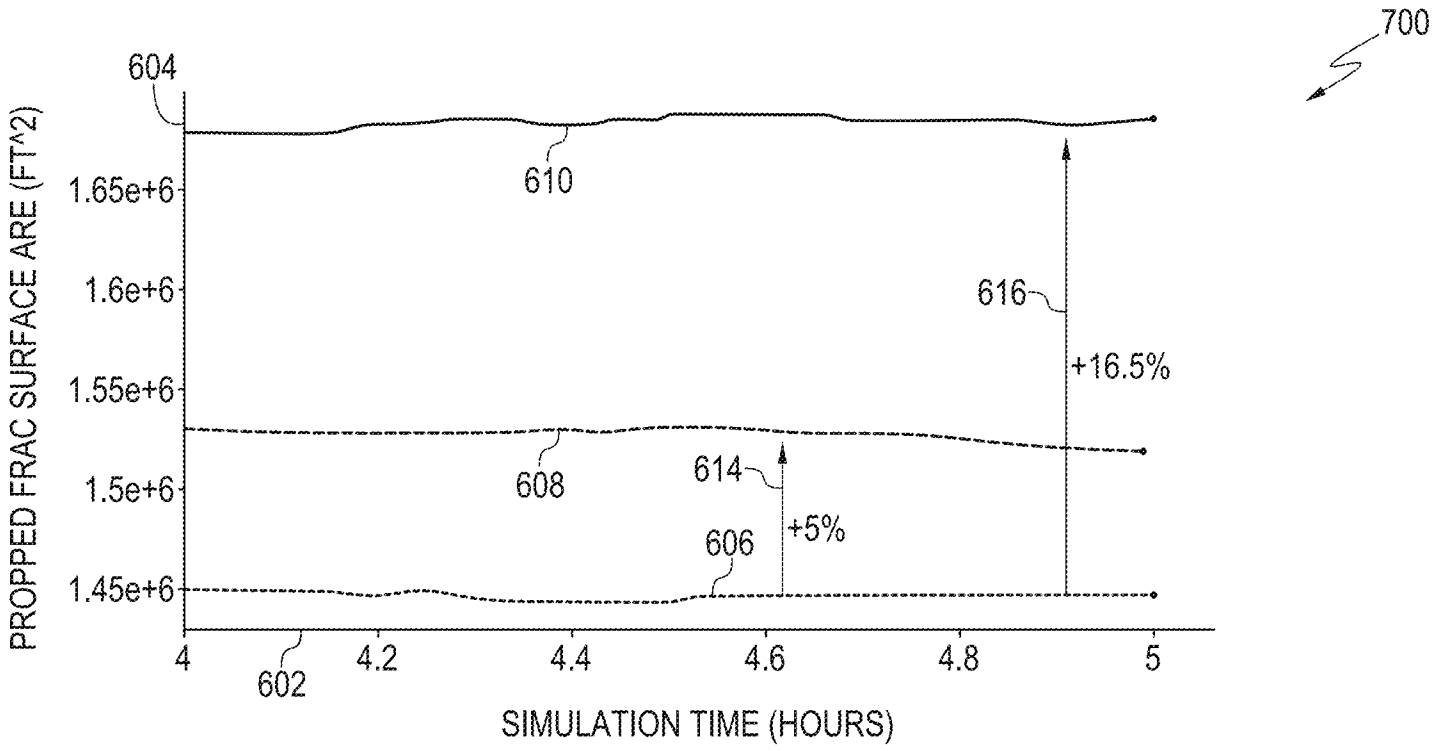
FIG. 7 is a graph showing an expanded view of a portion of the graph of FIG. 6.

FIG. 7 is a graph 700 showing an expanded view of a portion of the graph of FIG. 6. The graph 700 shows an expanded view of the region indicated in FIG. 6 by a box 612. The base scenario trace 606, the first attractor well trace 608 and the second attractor well trace 610 are shown on the graph 700. As shown by an arrow 614, the propped fracture surface area obtained from the fracturing operation represented by the first attractor well trace 608 is about 5% greater than the propped fracture surface area obtained from the fracturing operation represented by the base scenario trace 606. As shown by an arrow 616, the propped fracture surface area obtained from the fracturing operation represented by the second attractor well trace 610 is about 16.5% greater than the propped fracture surface area obtained from the fracturing operation represented by the base scenario trace 606.

FIG. 8 is a block diagram of an exemplary cluster computing system 800 that may be utilized to implement at least a portion of the present techniques. The exemplary cluster computing system 800 shown in FIG. 8 has four computing units 802A, 802B, 802C, and 802D, each of which may perform calculations for a portion of the present techniques. However, one of ordinary skill in the art will recognize that the cluster computing system 800 is not limited to this configuration, as any number of computing configurations may be selected. For example, a smaller analysis may be run on a single computing unit, such as a workstation, while a large calculation may be run on a cluster computing system 800 having tens, hundreds, or even more computing units.

The cluster computing system 800 may be accessed from any number of client systems 804A and 804B over a network 806, for example, through a high-speed network interface 808. The computing units 802A to 802D may also function as client systems, providing both local computing support and access to the wider cluster computing system 800.

The network 806 may include a local area network (LAN), a wide area network (WAN), the Internet, or any combinations thereof. Each client system 804A and 804B may include one or more non-transitory, computer-readable storage media for storing the operating code and program instructions that are used to implement at least a portion of the present techniques, as described further with respect to the non-transitory, computer-readable storage media of FIG. 8. For example, each client system 804A and 804B may include a memory device 810A and 810B, which may include random access memory (RAM), read only memory (ROM), and the like. Each client system 804A and 804B may also include a storage device 812A and 812B, which may include any number of hard drives, optical drives, flash drives, or the like.

The high-speed network interface 808 may be coupled to one or more buses in the cluster computing system 800, such as a communications bus 814. The communication bus 814 may be used to communicate instructions and data from the high-speed network interface 808 to a cluster storage system 816 and to each of the computing units 802A to 802D in the cluster computing system 800. The communications bus 814 may also be used for communications among the computing units 802A to 802D and the cluster storage system 816. In addition to the communications bus 814, a high-speed bus 818 can be present to increase the communications rate between the computing units 802A to 802D and/or the cluster storage system 816.

In some embodiments, the one or more non-transitory, computer-readable storage media of the cluster storage system 816 include storage arrays 820A, 820B, 820C and 820D for the storage of models, data, visual representations, results (such as graphs, charts, and the like used to convey results obtained using the present techniques), code, and other information concerning the implementation of at least a portion of the present techniques. The storage arrays 820A to 820D may include any combinations of hard drives, optical drives, flash drives, or the like.

Each computing unit 802A to 802D includes at least one processor 822A, 822B, 822C and 822D and associated local non-transitory, computer-readable storage media, such as a memory device 824A, 824B, 824C and 824D and a storage device 826A, 826B, 826C and 826D, for example. Each processor 822A to 822D may be a multiple core unit, such as a multiple core central processing unit (CPU) or a graphics processing unit (GPU). Each memory device 824A to 824D may include ROM and/or RAM used to store program instructions for directing the corresponding processor 822A to 822D to implement at least a portion of the present techniques. Each storage device 826A to 826D may include one or more hard drives, optical drives, flash drives, or the like. In addition, each storage device 826A to 826D may be used to provide storage for models, intermediate results, data, images, or code used to implement at least a portion of the present techniques.

The present techniques are not limited to the architecture or unit configuration illustrated in FIG. 8. For example, any suitable processor-based device may be utilized for implementing at least a portion of the embodiments described herein, including (without limitation) personal computers, laptop computers, computer workstations, mobile devices, and multi-processor servers or workstations with (or without) shared memory. Moreover, the embodiments described herein may be implemented, at least in part, on application specific integrated circuits (ASICs) or very-large-scale integrated (VLSI) circuits. In fact, those skilled in the art may utilize any number of suitable structures capable of executing logical operations according to the embodiments described herein.

Figure 9:
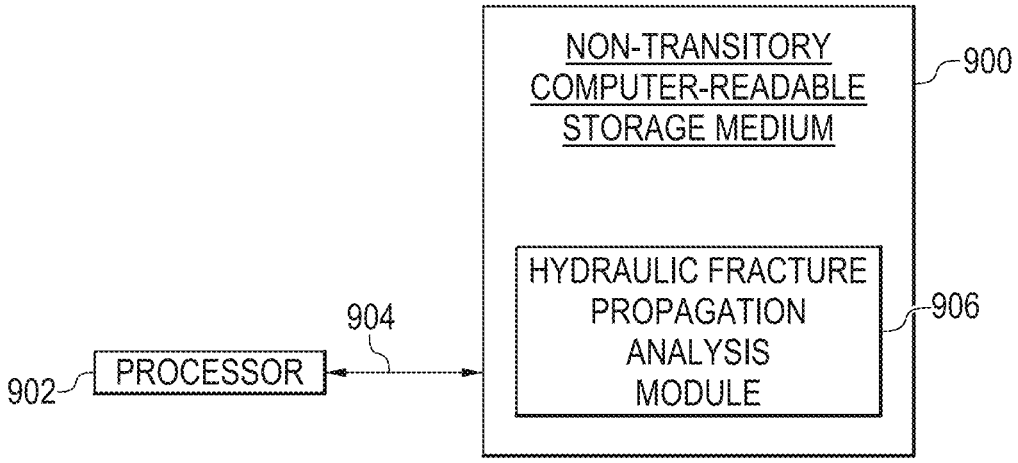
FIG. 9 is a block diagram of an exemplary non-transitory, computer-readable storage medium that may be used for the storage of data and modules of program instructions for implementing at least a portion of the present techniques.

FIG. 9 is a block diagram of an exemplary non-transitory, computer-readable storage medium 900 that may be used for the storage of data and modules of program instructions for implementing at least a portion of the present techniques. The non-transitory, computer-readable storage medium 900 may include a memory device, a hard disk, and/or any number of other devices, as described herein. A processor 902 may access the non-transitory, computer-readable storage medium 900 over a bus or network 904. While the non-transitory, computer-readable storage medium 900 may include any number of modules for implementing the present techniques, in some embodiments, the non-transitory, computer-readable storage medium 900 includes a hydraulic fracture propagation analysis module 906 for performing the techniques described herein (and/or any suitable variations thereof). Moreover, the hydraulic fracture propagation analysis module 906 may be adapted to analyze data representing the propagation of a hydraulic fracture network created by a treatment well 100 and an attractor well 102 according to the present techniques.

The hydraulic fracture propagation analysis module 906 may employ data such as influx data collected at the attractor well 102. This data may be used to calibrate a fracture model and potentially provide recommended changes to the operation of the treatment well 100 to optimize creation of propped surface area, as described herein.

In one or more embodiments, the present techniques may be susceptible to various modifications and alternative forms, such as the following embodiments as noted in paragraphs 1 to 60:

1. A method for propagating hydraulic fractures in a reservoir, comprising:
   creating a low pressure region in an attractor well, the attractor well being proximate to an area in which hydraulic fractures are desired; and
   initiating a hydraulic fracturing operation at a treatment well so that a fracture network created by the hydraulic fracturing operation is drawn to propagate toward the low pressure region of the attractor well.
2. The method of paragraph 1, wherein creating the low pressure region comprises placing the attractor well into production.
3. The method of paragraph 1 or 2, wherein creating the low pressure region comprises employing a downhole pump in the attractor well.
4. The method of any of paragraphs 1 to 3, wherein creating the low pressure region comprises reducing a hydrostatic fluid column of the attractor well to surface via gas injection.
5. The method of any of paragraphs 1 to 4, wherein the area in which hydraulic fractures are desired is an area likely to produce hydrocarbons.
6. The method of any of paragraphs 1 to 5, wherein the propagation of the fracture network toward the attractor well results in the fracture network increasing hydrocarbon production in the reservoir.
7. The method of any of paragraphs 1 to 6, comprising mapping the fracture network.
8. The method of any of paragraphs 1 to 7, wherein mapping the fracture network comprises characterizing an extent of fracture systems around the attractor well.
9. The method of paragraph 8, wherein the fracture systems include both planar and complex fracture systems.
10. The method of any of paragraphs 1 to 9, wherein the reservoir has multiple attractor wells.
11. The method of any of paragraphs 1 to 10, wherein the reservoir has multiple treatment wells.

12. The method of any of paragraphs 1 to 11, comprising generating a well spacing plan based on the fracture network between the treatment well and the attractor well.

13. The method of paragraph 12, comprising drilling at least one well in accordance with the well spacing plan.

14. The method of any of paragraphs 1 to 13, comprising generating a well spacing plan based on an extent and magnitude of depletion induced in the attractor well.

15. The method of any of paragraphs 1 to 14, comprising: selecting a location of the attractor well for the purpose of maximizing propped surface area of the fracture network; and drilling the attractor well at the location.

16. The method of any of paragraphs 1 to 14, comprising: selecting a location of the attractor well for the purpose of maximizing conductive fracture geometry of the fracture network; and drilling the attractor well at the location.

17. The method of any of paragraphs 1 to 14, comprising: selecting a location of the attractor well so that the fracture network will improve productivity of the reservoir; and drilling the attractor well at the location.

18. The method of any of paragraphs 1 to 17, wherein the attractor well has an existing fracture network, and wherein the low pressure region causes a change in distribution of proppant in the fracture network created by the hydraulic fracturing operation.

19. The method of any of paragraphs 1 to 18, wherein the fracture network connects to perforations in the attractor well.

20. The method of any of paragraphs 1 to 19, wherein the fracture network connects to an existing fracture network of the attractor well.

21. The method of any of paragraphs 1 to 19, wherein the fracture network connects to an open slot of the attractor well.

22. The method of any of paragraphs 1 to 21, wherein the low pressure region is designed to have a specific magnitude to direct propagation of the fracture network.

23. The method of any of paragraphs 1 to 22, wherein the low pressure region is created for a specific period of time prior to initiating the hydraulic fracturing operation.

24. The method of any of paragraphs 1 to 23, comprising shutting in the attractor well prior to the initiating of the hydraulic fracturing operation.

25. A well system, comprising: an attractor well having a low pressure region created therein, the attractor well being proximate to an area in which hydraulic fractures are desired; and a treatment well at which a hydraulic fracturing operation is initiated so that a fracture network created by the hydraulic fracturing operation is drawn to propagate toward the low pressure region of the attractor well.

26. The well system of paragraph 25, the low pressure region being created by placing the attractor well into production.

27. The well system of paragraph 25, the low pressure region being created by a downhole pump in the attractor well.

28. The well system of paragraph 25, the low pressure region being created by reducing a hydrostatic fluid column of the attractor well to surface via gas injection.

29. The well system of any of paragraphs 25 to 28, wherein the area in which hydraulic fractures are desired is an area likely to produce hydrocarbons.

30. The well system of any of paragraphs 25 to 29, wherein: a location of the attractor well is selected for the purpose of maximizing propped surface area of the fracture network; and the attractor well is drilled at the location.

31. The well system of any of paragraphs 25 to 29, wherein: a location of the attractor well is selected for the purpose of maximizing conductive fracture geometry of the fracture network; and the attractor well is drilled at the location.

32. The well system of any of paragraphs 25 to 29, wherein: a location of the attractor well is selected so that the fracture network will improve productivity of the reservoir; and the attractor well is drilled at the location.

33. The well system of any of paragraphs 25 to 32, wherein the propagation of the fracture network toward the attractor well results in the fracture network increasing hydrocarbon production in the reservoir.

34. The well system of any of paragraphs 25 to 33, wherein the fracture network is mapped.

35. The well system of any of paragraphs 25 to 34, wherein a reservoir containing the attractor well has multiple attractor wells.

36. The well system of any of paragraphs 25 to 35, wherein a reservoir containing the attractor well has multiple treatment wells.

37. The well system of any of paragraphs 25 to 36, wherein a well spacing plan is generated based on the fracture network.

38. The well system of paragraph 37, wherein at least one well is drilled in accordance with the well spacing plan.

39. The well system of any of paragraphs 25 to 38, wherein a well spacing plan is generated based on an extent and magnitude of depletion induced in the attractor well.

40. The well system of any of paragraphs 25 to 39, wherein the attractor well has an existing fracture network, and wherein the low pressure region causes a change in distribution of proppant in the fracture network created by the hydraulic fracturing operation of the treatment well.

41. The well system of any of paragraphs 25 to 40, wherein the fracture network connects to perforations in the attractor well.

42. The well system of any of paragraphs 25 to 40, wherein the fracture network connects to an existing fracture network of the attractor well.

43. The well system of any of paragraphs 25 to 40, wherein the fracture network connects to an open slot of the attractor well.

44. The well system of any of paragraphs 25 to 43, wherein the low pressure region is designed to have a specific magnitude to direct propagation of the fracture network.

45. The well system of any of paragraphs 25 to 44, wherein the low pressure region is created for a specific period of time prior to initiating the hydraulic fracturing operation.

46. The well system of any of paragraphs 25 to 45, wherein the attractor well is shut in prior to the initiating of the hydraulic fracturing operation.

47. A well system, comprising: an attractor well having a low pressure region created therein, the attractor well being proximate to an area in which hydraulic fractures are desired; a treatment well at which a hydraulic fracturing operation is initiated so that a fracture network created by the hydraulic fracturing operation is drawn to propagate toward the low pressure region of the attractor well; and a computing system that calculates an aspect of the fracture network to provide an input to a subsequent hydraulic fracturing operation.

48. The well system of paragraph 47, wherein the aspect of the fracture network comprises mapping the fracture network.

49. The well system of paragraph 48, wherein mapping the fracture network comprises characterizing an extent of fracture systems around the attractor well.

50. The well system of paragraph 49, wherein the fracture systems include both planar and complex fracture systems.

51. The well system of any of paragraphs 47 to 50, wherein: a location of the attractor well is selected for the purpose of maximizing propped surface area of the fracture network; and the attractor well is drilled at the location.

52. The well system of any of paragraphs 47 to 50, wherein: a location of the attractor well is selected for the purpose of maximizing conductive fracture geometry of the fracture network; and the attractor well is drilled at the location.

53. The well system of any of paragraphs 47 to 50, wherein: a location of the attractor well is selected so that the fracture network will improve productivity of the reservoir; and the attractor well is drilled at the location.

54. The well system of any of paragraphs 47 to 53, wherein the attractor well has an existing fracture network, and wherein the low pressure region causes a change in distribution of proppant in the fracture network created by the hydraulic fracturing operation.

55. The well system of any of paragraphs 47 to 54, wherein the fracture network connects to perforations in the attractor well.

56. The well system of any of paragraphs 47 to 54, wherein the fracture network connects to an existing fracture network of the attractor well.

57. The well system of any of paragraphs 47 to 54, wherein the fracture network connects to an open slot of the attractor well.

58. The well system of any of paragraphs 47 to 57, wherein the low pressure region is designed to have a specific magnitude to direct propagation of the fracture network.

59. The well system of any of paragraphs 47 to 58, wherein the low pressure region is created for a specific period of time prior to initiating the hydraulic fracturing operation.

60. The well system of any of paragraphs 47 to 59, wherein the attractor well is shut in prior to the initiating of the hydraulic fracturing operation.

While the embodiments described herein are well-calculated to achieve the advantages set forth, it will be appreciated that such embodiments are susceptible to modification, variation, and change without departing from the spirit thereof. In other words, the particular embodiments described herein are illustrative only, as the teachings of the present techniques may be modified and practiced in different but equivalent manners apparent to those skilled in the art having the benefit of the teachings herein. Moreover, the systems and methods illustratively disclosed herein may suitably be practiced in the absence of any element that is not specifically disclosed herein and/or any optional element disclosed herein. While compositions and methods are described in terms of "comprising" or "including" various components or steps, the compositions and methods can also "consist essentially of" or "consist of" the various components and steps. Indeed, the present techniques include all alternatives, modifications, and equivalents falling within the true spirit and scope of the appended claims.

What is claimed is:

1. A method for propagating hydraulic fractures in a reservoir, comprising:

creating a low pressure region in an attractor well, the attractor well being proximate to an area in which hydraulic fractures are desired; and initiating a hydraulic fracturing operation at a treatment well so that a fracture network created by the hydraulic fracturing operation is drawn to propagate toward the low pressure region of the attractor well.

2. The method of claim 1, wherein creating the low pressure region comprises placing the attractor well into production.

3. The method of claim 1, wherein creating the low pressure region comprises employing a downhole pump in the attractor well.

4. The method of claim 1, wherein creating the low pressure region comprises reducing a hydrostatic fluid column of the attractor well to surface via gas injection.

5. The method of claim 1, wherein the area in which hydraulic fractures are desired is an area likely to produce hydrocarbons.

6. The method of claim 1, wherein the propagation of the fracture network toward the attractor well results in the fracture network increasing hydrocarbon production in the reservoir.

7. The method of claim 1, comprising mapping the fracture network.

8. The method of claim 7, wherein mapping the fracture network comprises characterizing an extent of fracture systems around the attractor well.

9. The method of claim 8, wherein the fracture systems include both planar and complex fracture systems.

10. The method of claim 1, wherein the reservoir has multiple attractor wells.

11. The method of claim 1, wherein the reservoir has multiple treatment wells.

12. The method of claim 1, comprising generating a well spacing plan based on the fracture network between the treatment well and the attractor well.

13. The method of claim 12, comprising drilling at least one well in accordance with the well spacing plan.

14. The method of claim 1, comprising generating a well spacing plan based on an extent and magnitude of depletion induced in the attractor well.

15. The method of claim 1, comprising:

selecting a location of the attractor well for the purpose of maximizing propped surface area of the fracture network; and drilling the attractor well at the location.

16. A well system, comprising:

an attractor well having a low pressure region created therein, the attractor well being proximate to an area in which hydraulic fractures are desired; and a treatment well at which a hydraulic fracturing operation is initiated so that a fracture network created by the hydraulic fracturing operation is drawn to propagate toward the low pressure region of the attractor well.

17. The well system of claim 16, the low pressure region being created by placing the attractor well into production.

18. A well system, comprising:

an attractor well having a low pressure region created therein, the attractor well being proximate to an area in which hydraulic fractures are desired;

a treatment well at which a hydraulic fracturing operation is initiated so that a fracture network created by the hydraulic fracturing operation is drawn to propagate toward the low pressure region of the attractor well; and a computing system that calculates an aspect of the fracture network to provide an input to a subsequent hydraulic fracturing operation.

19. The well system of claim 18, wherein the aspect of the fracture network comprises mapping the fracture network.

20. The well system of claim 18, wherein mapping the fracture network comprises characterizing an extent of fracture systems around the attractor well.

* * * * *